US008505460B2

(12) United States Patent
Kickbush

(10) Patent No.: US 8,505,460 B2
(45) Date of Patent: Aug. 13, 2013

(54) GAS ACTUATED RETARDER SYSTEM FOR RAILWAY CAR

(75) Inventor: Gregory F. Kickbush, Thiensville, WI (US)

(73) Assignee: Trackside Services, Inc., Milwaukee, WI (US)

( * ) Notice: Subject to any disclaimer, the term of this patent is extended or adjusted under 35 U.S.C. 154(b) by 0 days.

(21) Appl. No.: 13/613,044

(22) Filed: Sep. 13, 2012

(65) Prior Publication Data

US 2013/0068124 A1 Mar. 21, 2013

Related U.S. Application Data

(60) Provisional application No. 61/535,823, filed on Sep. 16, 2011.

(51) Int. Cl.
*B61K 7/02* (2006.01)

(52) U.S. Cl.
USPC ..... 104/26.2; 104/26.1; 188/62

(58) Field of Classification Search
USPC ..... 104/26.1, 26.2; 188/43, 62
See application file for complete search history.

(56) References Cited

U.S. PATENT DOCUMENTS

| | | | | |
|---|---|---|---|---|
| 2,326,924 | A | | 8/1943 | Bowe |
| 3,196,985 | A | | 7/1965 | Rowe |
| 3,659,680 | A | | 5/1972 | Soulakis et al. |
| 3,946,973 | A | | 3/1976 | Budway et al. |
| 4,030,574 | A | | 6/1977 | Evans |
| 4,125,177 | A | | 11/1978 | Durraffourt |
| 4,198,909 | A | | 4/1980 | Plantureux |
| 4,513,843 | A | | 4/1985 | Danieli |
| 4,535,872 | A | | 8/1985 | Bick et al. |
| 4,650,038 | A | | 3/1987 | Bick |
| 4,867,279 | A | * | 9/1989 | Link et al. ..... 188/62 |
| 5,015,131 | A | | 5/1991 | Schmidt et al. |
| 5,092,248 | A | | 3/1992 | Parry |
| 5,333,707 | A | | 8/1994 | Kaneda |
| 5,388,525 | A | * | 2/1995 | Bodkin ..... 104/26.2 |
| 5,575,218 | A | * | 11/1996 | Gutknecht ..... 104/249 |
| 5,676,337 | A | | 10/1997 | Giras et al. |
| RE36,084 | E | | 2/1999 | Gutknecht |
| 6,152,042 | A | * | 11/2000 | Barry et al. ..... 104/26.2 |
| 6,216,525 | B1 | * | 4/2001 | Bernd et al. ..... 73/11.06 |

(Continued)

FOREIGN PATENT DOCUMENTS

JP 2010132092 6/2010

OTHER PUBLICATIONS

PCT Search Report from PCT/US2012/055017 issued on Dec. 21, 2012.

*Primary Examiner* — Jason C Smith
(74) *Attorney, Agent, or Firm* — Reinhart Boerner Van Deuren s.c.

(57) ABSTRACT

There is disclosed a method and a gas actuated retarder system for railway cars to control the rolling speed of a railway car along a first and second running rails of a track section. The retarder system includes a plurality of steel ties positioned substantially parallel to each other and perpendicular to the first and second running rails of a track section. A plurality of gas bladder mounts are positions between the running rails of the gas actuated retarder system. Coupled to each of the gas bladder mounts are air bladders with one air bladder on a side of the centerline of the gas actuated retarder system. Inflating and deflating the gas bladder selectively controls the amount of speed reduction of the railcar.

16 Claims, 6 Drawing Sheets

(56) References Cited

U.S. PATENT DOCUMENTS

| | | | | |
|---|---|---|---|---|
| 6,220,400 | B1 * | 4/2001 | Kickbush | 188/62 |
| 6,463,861 | B1 | 10/2002 | Nottingham | |
| 6,829,998 | B1 * | 12/2004 | Kickbush | 104/26.2 |
| 7,140,302 | B2 * | 11/2006 | Kickbush | 104/26.2 |
| 7,299,751 | B2 * | 11/2007 | Kickbush | 104/26.2 |
| 7,306,077 | B2 | 12/2007 | Heyden et al. | |
| 7,325,567 | B2 * | 2/2008 | Heyden et al. | 137/596.17 |
| 7,392,887 | B2 * | 7/2008 | Heyden et al. | 188/170 |
| 7,530,432 | B2 * | 5/2009 | Heyden | 188/62 |
| 8,365,876 | B2 * | 2/2013 | Mazur et al. | 188/62 |
| 2005/0120903 | A1 * | 6/2005 | Kickbush | 104/262 |
| 2006/0225968 | A1 * | 10/2006 | Heyden et al. | 188/62 |
| 2007/0062407 | A1 * | 3/2007 | Kickbush | 104/249 |
| 2009/0045019 | A1 * | 2/2009 | Heyden | 188/153 D |
| 2013/0068124 | A1 * | 3/2013 | Kickbush | 104/26.2 |

* cited by examiner

GAS ACTUATED RETARDER SYSTEM FOR RAILWAY CAR

CROSS-REFERENCE TO RELATED PATENT APPLICATIONS

This patent application is a non-provisional application and claims priority to U.S. Provisional Patent Application No. 61/535,823, filed on Sep. 16, 2011, which is hereby incorporated herein in full by this reference.

BACKGROUND OF THE INVENTION

Field of the Invention

This invention relates a railway braking systems, and more particularly, to an gas actuated retarder for controlling the rolling speed of a railway car along a track section.

Existing braking systems generally include pneumatic or hydraulic piston cylinder actuators which activate frictional braking members. In some systems, a railway wheel is pinched from both sides of the running rail to retard rolling movement of the rail cars. In other systems, the cylinder pushes a brake shoe against a rail wheel to retard its rolling motion.

The apparatus of the present disclosure must also be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present disclosure.

There is disclosed a gas actuated retarder system to resist movement of a railcar moving on wheels along a track section having a first and second running rail. The gas actuator retarder system includes a plurality of steel ties positioned substantially parallel to each other and perpendicular to the first and second running rails of the track section. The track section is typically installed in a classification yard or a hump yard of a railroad company's facility. The track section which is a part of the gas actuator retarder system, because of its modular configuration, is typically manufactured in a length specified by a customer or user which typically is governed by requirements at a specific railroad installation.

A plurality of gas bladder actuators are disposed between the running rails of the track section.

Each of the gas bladder actuators includes a gas bladder mount. The gas bladder mount, in one embodiment is positioned between the running rails of the track section equidistant from each of the running rails. A first gas bladder and a second gas bladder are each coupled to the gas bladder mount with one gas bladder on each side of the bladder mount. A pair of lever arms are coupled to each of the gas bladders at one end of each lever arm. A second end of the lever arm is coupled pivotally to a pivot pin which itself is secured to one of the steel ties making up the track section.

A fulcrum bar is coupled to each of the lever arms and to each of the pivot pins. The lever arms are configured to rotate about the pivot pin as the gas bladders coupled to the gas bladder mounts are inflated and deflated.

A brake clevis, including a link arm, is coupled between the first and second ends of each lever arm proximate the pivot pin. The brake clevis extends toward the running rail on each side of the track section.

A gas supply line is coupled to each of the gas bladders of each of the gas bladder actuators with the gas supply line configured to expand each of the gas bladders. In one embodiment, a controller is coupled to the gas supply line and is configured to selectively control the expansion and deflation of the gas bladders in each of the gas bladder actuators.

A pair of brake beams, with one beam coupled to each clevis on one side of each of the plurality of gas bladder actuators is provided. Each brake beam is parallel to one of the running rails. A brake shoe is coupled to each brake beam and is configured to engage the wheels of the railroad car when the gas bladder actuators are inflated and disengage the wheels when the gas bladders are deflated. The brake beam is configured to extend the entire length of the gas actuated retarder system in order to provide a more consistent application of frictional force to the rail car wheels as the railcar passes through the retarder.

In another embodiment, a second lever arm is coupled to each of the other lever arms of each of the gas bladder actuators. With the second lever arm disposed in a spaced distance below the other lever arm, the second lever arm is coupled to the corresponding gas bladder and pivot pin of the other lever arm. The two lever arms define a box with the pivot pin and the gas bladders.

In another embodiment, ultra-high molecular weight plastic members are disposed in a sliding area under each of the lever arms and brake beam. Use of such ultra-high molecular weight plastic members minimizes the amount of lubrication, for example grease, that must be used with the gas actuator retarder system during its lifetime. The ultra-high molecular weight plastic members can be replaced as they wear or become damaged.

The gas utilized in the gas actuator retarder system can be one of air and nitrogen.

There is further provided a gas actuator retarder system to resist movement of the railcar moving on wheels along a track section having a first and second running rail. The gas actuated retarder system includes a plurality of steel ties positioned substantially parallel to each other and perpendicular to the first and second running rails of the track section. A plurality of gas bladder actuators are disposed between the running rails.

Each gas bladder actuator includes a gas bladder mount to which a first gas bladder and a second gas bladder are coupled. In this embodiment, each of the first and second gas bladders are coupled to two of the gas bladder mounts with one gas bladder on an opposite side of the bladder mount.

A pair of lever arms, are provided, with each lever arm having a first and a second end. The first end of each lever arm is coupled to one of the gas bladders and the second end of each lever is pivotally coupled to a pivot pin secured to one of the steel ties. A fulcrum bar is coupled to each of the second ends of the two levers and to each pivot pin.

A first clevis including a link arm, is coupled between the first and second ends of each lever arm approximate the pivot pin. The clevis extends toward the running rail on each side of the track section. A second clevis is coupled between the first end and the first clevis to each lever arm and a compression spring is coupled to each of the second clevises with the compression spring configured to exert a force against each lever arm causing the lever arm to pivot about the respective pivot pin and move the first clevis away from each of the running rails of the track section. The first clevis is also referred to as a brake clevis and the second clevis is referred to as a lever clevis. In a preferred embodiment, two compression springs positioned side by side are coupled to each of the second clevises as described above. The size of the compression springs can vary depending on the particular application to which the gas actuator retarder system is to be applied.

A gas supply line is coupled to each of the gas bladders of each of the gas bladder actuators and is configured to expand each gas bladder. Conventional gas valves or actuators are used to deflate the gas bladder as controlled by the controller.

A pair of brake beams, with one beam coupled to each clevis on each side of each of the plurality of gas bladder actuators is provided. Each brake beam is parallel to one of the running rails. In one embodiment, the brake beam substantially extends the full length of the gas actuator retarder system. For purposes of this application, substantially extending the full length of the gas actuator retarder system means at least beyond, at each end of the retarder system, each of the gas bladder actuators.

A brake shoe is coupled to each brake beam and is configured to engage the wheels of the railway car when the gas bladder actuators are deflated and disengage the wheels when the gas bladders are inflated.

In another embodiment, a controller is coupled to the gas supply line and is configured to selectively control the expansion and deflation of the gas bladders in each of the gas bladder actuators by use of control gas valves. In a further embodiment, a second lever arm is coupled to each of the lever arms of each of the gas bladder actuators. The second lever arm is disposed a spaced distance below the other lever arm with the second lever arm coupled to the corresponding gas bladder and pivot pin of the other lever arm. This configuration of the two lever arms, respective gas bladder and pivot pin define a box. Further, in predetermined sliding areas, an ultra-high molecular weight plastic member is disposed to facilitate movement of the brake beam and lever arms during operation of a gas actuated retarder system.

There is also disclosed a method to reduce the velocity of a free moving railcar supported with wheels and running rails of a track section. The method includes transferring the railcar wheel forces horizontally to a brake beam coupled to a gas bladder actuator and resisting the horizontal wheel force with an opposite force exerted on the brake beam by one of inflating and deflating a gas bladder coupled to a lever arm coupled to the brake beam with a clevis. The force on the brake beam from the wheels and the force on the brake beam from the gas bladder actuator oppose the railcar wheel rolling forces and reduce the railcar velocity of the free moving railcar.

The apparatus of the present invention is of a construction which is both durable and long lasting, and which will require little or no maintenance to be provided by the user throughout its operating lifetime. Finally, all of the aforesaid advantages and objectives are achieved without incurring any substantial relative disadvantage.

DESCRIPTION OF THE DRAWINGS

These and other advantages of the present disclosure are best understood with reference to the drawings, in which.

DETAILED DESCRIPTION OF EXEMPLARY EMBODIMENTS

Figure 1:
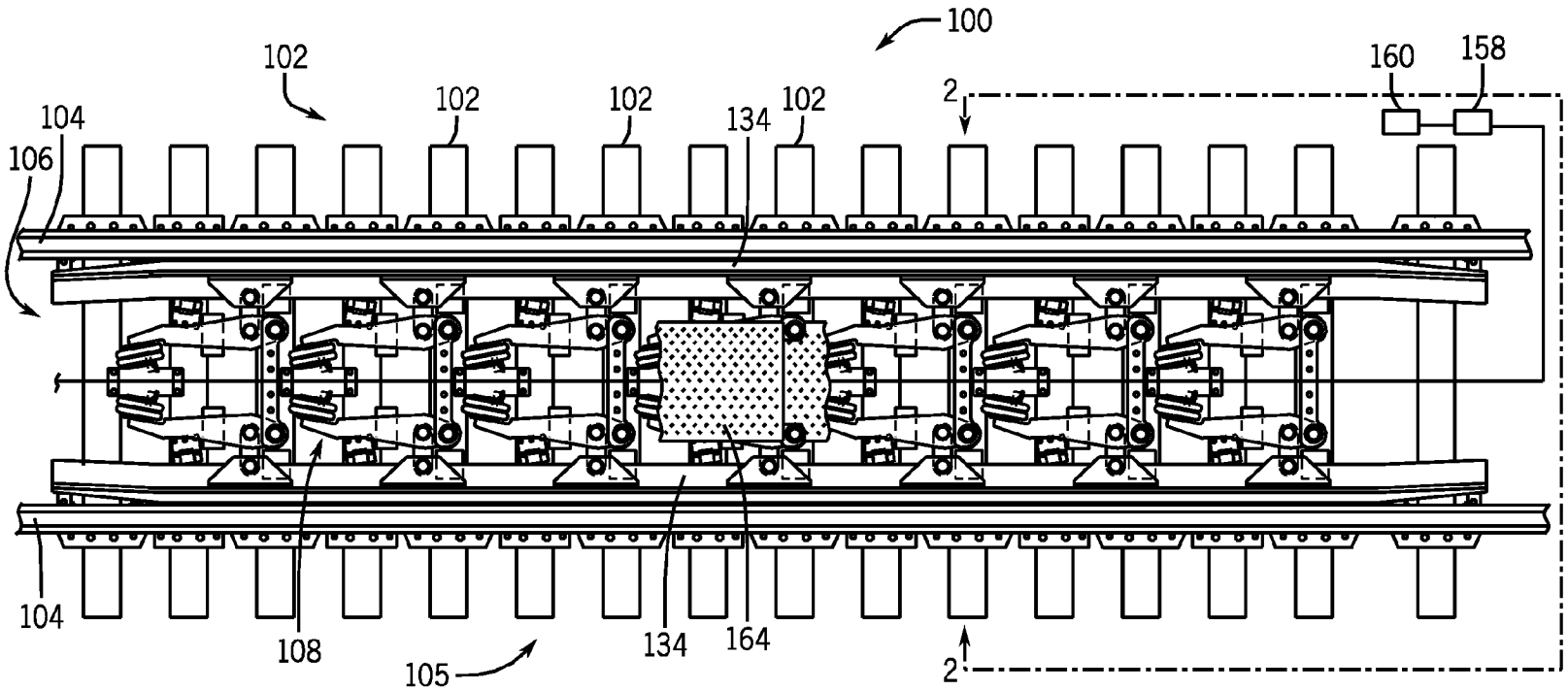
FIG. 1 is a top view of an exemplary embodiment of a gas actuated retarder system for controlling rolling speed of a rail car by inflating gas bladders.
Figure 2:
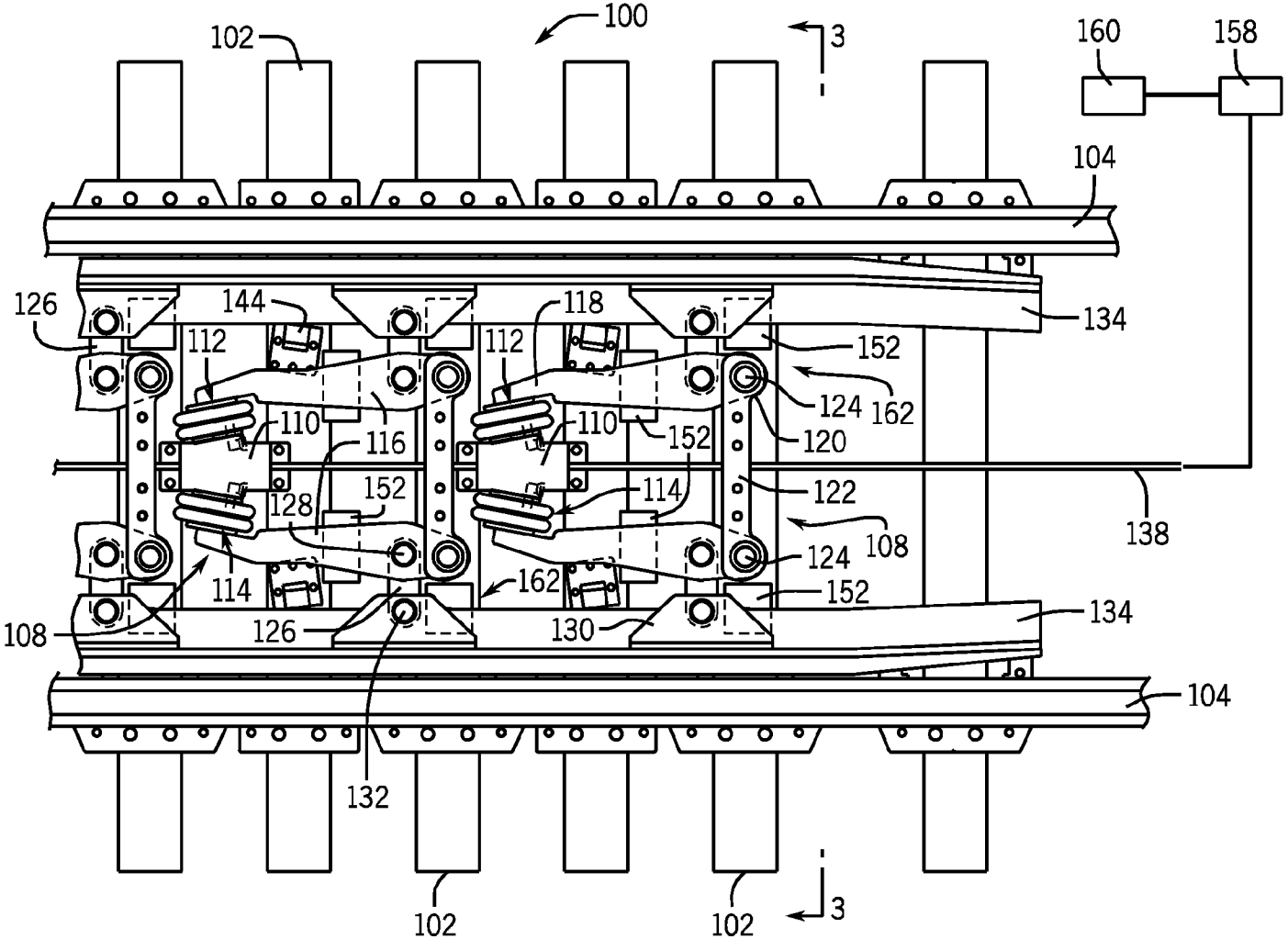
FIG. 2 is a partial detail top view of the gas actuated retarder system illustrated in FIG. 1 along the line 2-2.
Figure 3:
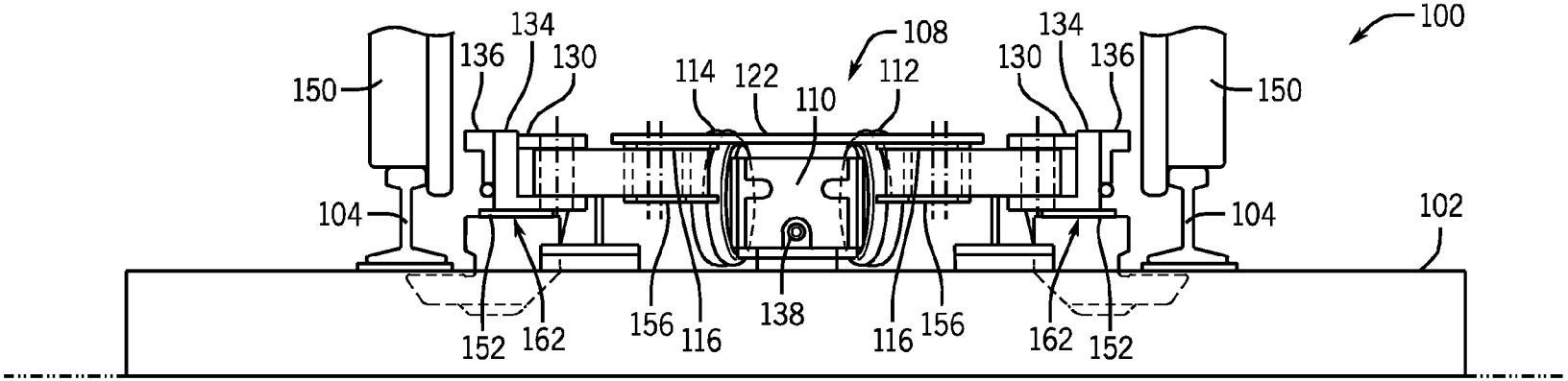
FIG. 3 is an end view illustration of the gas actuated retarder illustrated in FIG. 2 along the line 3-3 with the gas actuated retarder not engaged with the wheels of a railway car.
Figure 4:
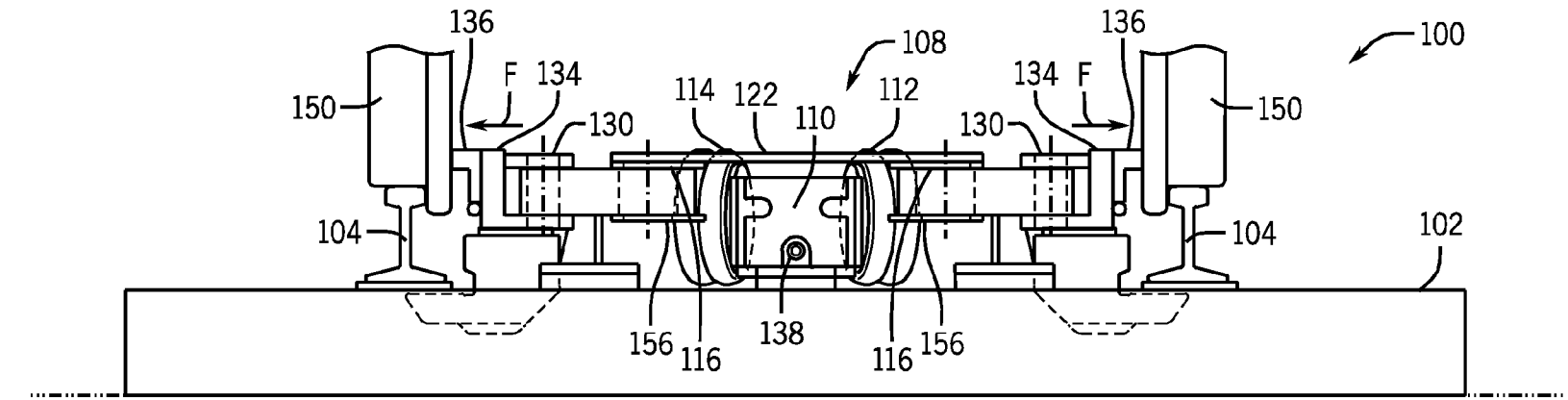
FIG. 4 is an end view illustration of the gas actuated retarder illustrated in FIG. 2 along the line 3-3 with the gas retarder system engaging the rail wheels of a railway car.

Referring to FIGS. 1-8, there is disclosed a method and a gas actuated retarder system 100 for railway cars to control the rolling speed of a railway car along a first and second running rails 104 of a track section 105. The retarder system 100 includes a plurality of steel ties 102 positioned substantially parallel to each other and perpendicular to the first and second running rails 104 of a track section 105. A plurality of gas bladder mounts 110 are positions between the running rails 104 of the gas actuated retarder system 100. Coupled to each of the gas bladder mounts 110 are gas bladders 112, 114 with one gas bladder on a side of the centerline of the gas actuated retarder system 100. Inflating and deflating the gas bladder 112, 114 selectively controls the amount of speed reduction of the railcar.

A fulcrum bar 122 is coupled to lever arms 116 and pivot pins 124. The fulcrum bar 122 is positioned perpendicular to the centerline of the gas bladder actuation 108 and coupled to the steel tie 102 by fasteners, for example bolts, or welded to the steel tie.

A pair of lever arms 116 are disposed between the first and second running rails 104, with each lever arm 116 coupled to a gas bladder 112, 114 and the fulcrum bar 122. One lever arm 116 is disposed on each side of the gas bladder mount 110 of the gas bladder actuator 108. A brake clevis 130, including a link arm 126 is coupled to each lever arm 116 proximate the pivot pin 124 at the fulcrum bar 122, with the brake clevis 130 coupled to a brake beam 134. The brake beam 134 is aligned parallel to one of the first and second running rails 104.

Figure 5:
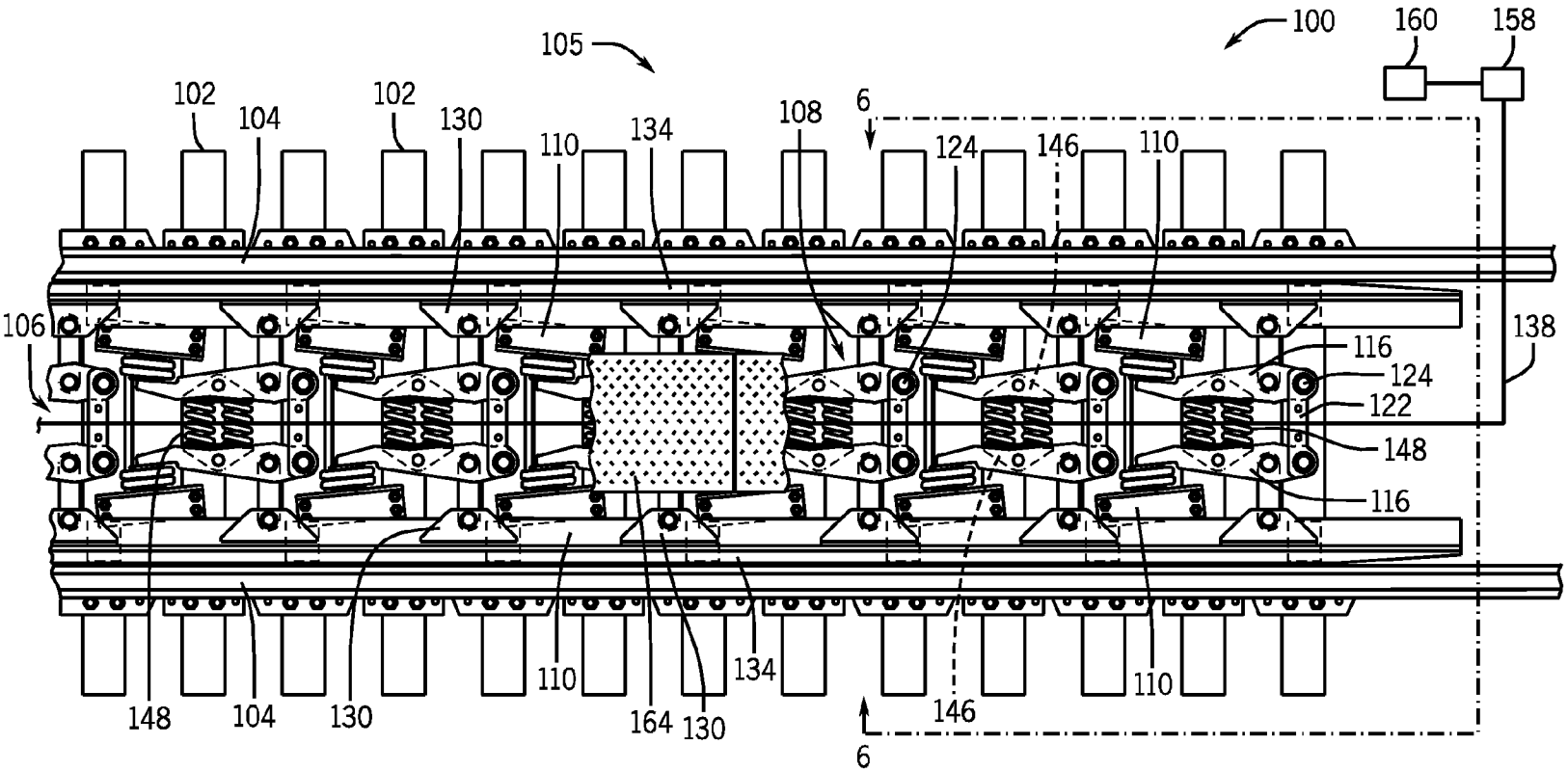
FIG. 5 is a top view of an exemplary embodiment of a gas actuated retarder system for controlling rolling speed of a rail car by deflating gas bladders.
Figure 6:
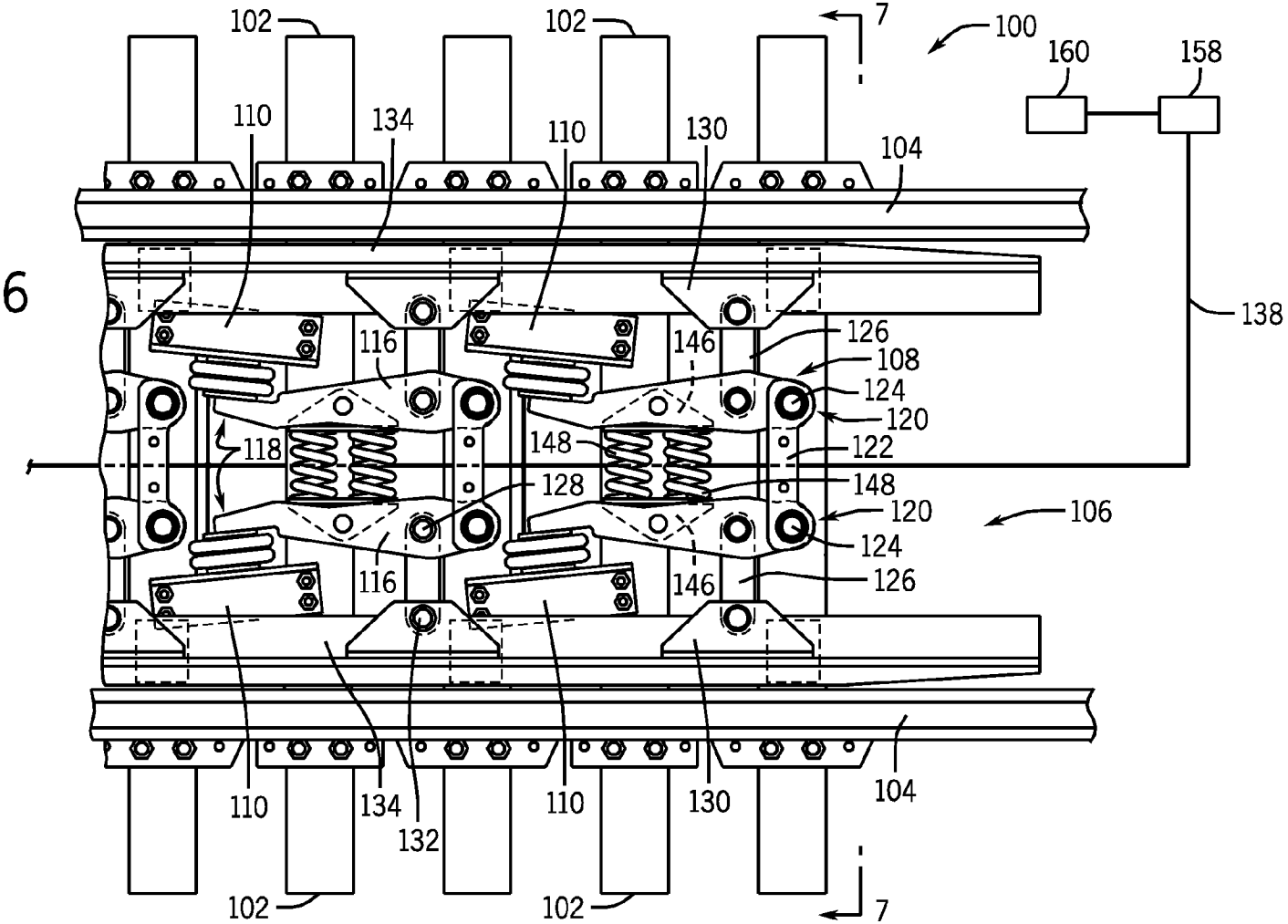
FIG. 6 is a partial detail top view of the gas actuated retarder system illustrated in FIG. 5 along the line 6-6.
Figure 7:
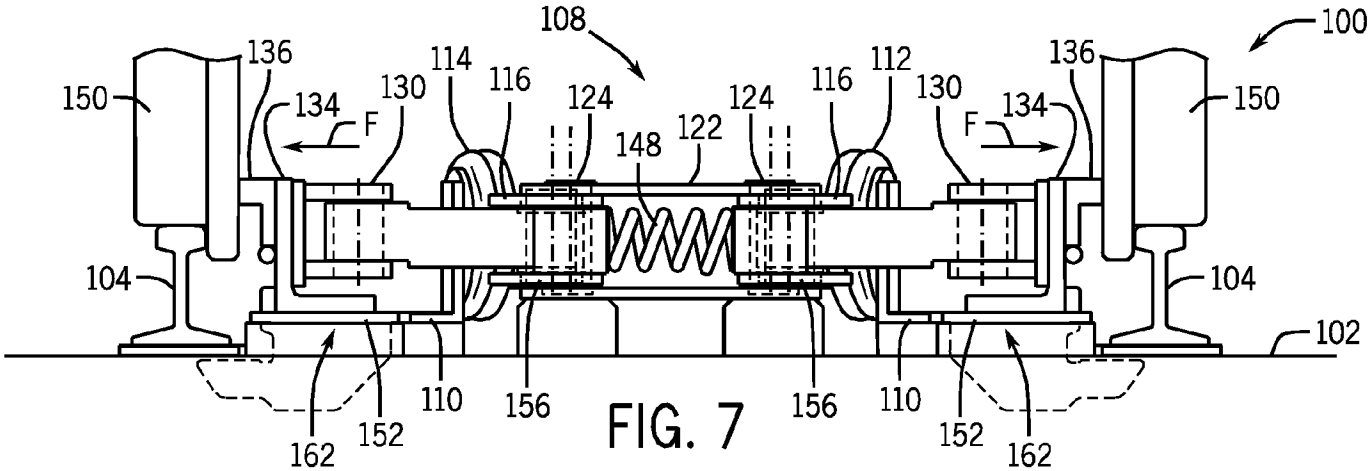
FIG. 7 is an end view illustration of the gas actuated retarder illustrated in FIG. 6 along the line 7-7 with the gas retarder system engaging the rail wheels of a railway car.
Figure 8:
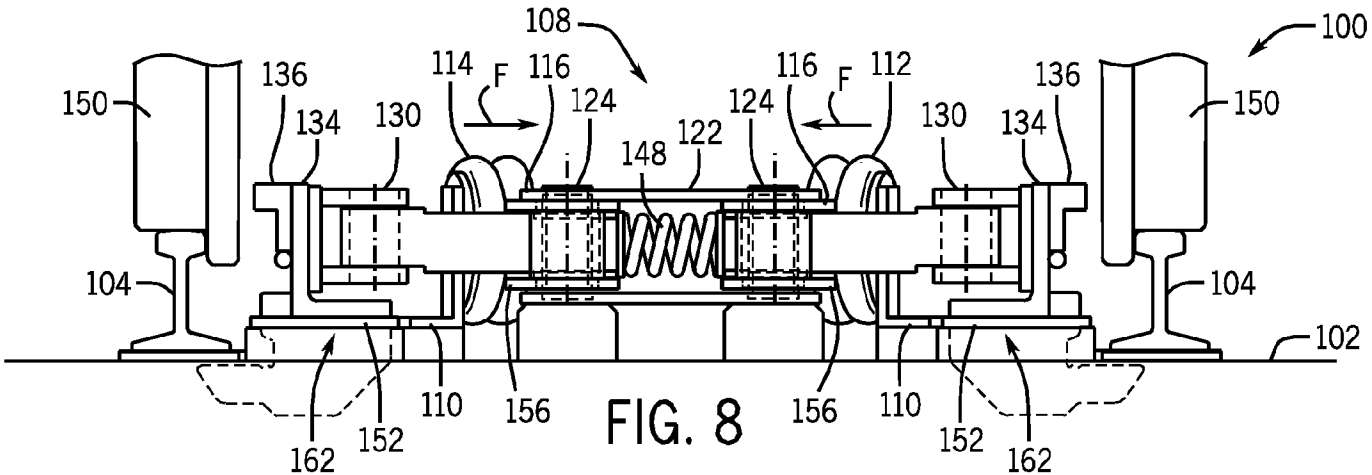
FIG. 8 is an end view illustration of the gas actuated retarder illustrated in FIG. 6 along the line 7-7 with the gas actuated retarder not engaged with the wheels of a railway car.

As illustrated in FIGS. 1 and 5, a plurality of clevises 130 couples to a plurality of lever arms 116 and gas bladders 112, 114 make up the gas actuated retarder system 100. It should be understood that the gas actuated retarder system 100 in accord with the present disclosure is not limited to seven clevises 130 and seven pairs of gas bladders 112, 114 and associated levers 116, 122, 126, 134 as illustrated in FIGS. 1 and 5 but can be as many or as few as determined by the user of the disclosed gas actuated retarder system 100.

The brake beam 134 may be a single beam or may be a plurality of beams aligned horizontally and parallel to the running rail of a track section. The preferred embodiment provides a brake beam 134 extending substantially the full length of the retarder system 100. (See FIGS. 1 and 5) Each brake beam includes at least one brake shoe 136.

Typically a plurality of brake shoes 136 are coupled to the brake beam 134 and configured to do one of apply a frictional force to a passing railway car wheel 150 and release a force from a passing railway car when the gas bladders 112, 114 expand or deflate. Such action causes the lever arm 116 to pivot about the pivot pin 124 and push the clevises 130 and attached brake beam 134 towards the running rails 104 and engage railcar wheels 150. Each of the lever arms 116 has an associated lever arm stop 144 positioned to limit the distance the lever arm 116 moves when the air bladder 112, 114 is expanded.

A biasing member such as a compression spring 148 may be positioned between the brake beam 134 and the running rails 104 to move the brake beam 134 back towards each of the air actuated retarders 108 when air pressure in the air bladders 112, 114 are relieved. A typical compression spring 148 is a coil spring of sufficient size and strength for its intended purpose.

In another embodiment, a second clevis 146, also referred to as a lever clevis, is coupled between the first end 118 and the first clevis 130, referred to as the brake clevis, to each lever arm 116 and a compression spring 148 coupled to each of the second clevises 146 with the compression spring 148 configured to exert a force against each lever arm 116 causing the lever arms 116 to pivot about the respective pivot pin 124 and move the first clevis 130 away from each of the running rails 104 of the track section 105. In this configuration, the brake shoes 136 coupled to each of the brake beams 134 are configured to engage the wheels 150 of the railroad car when the gas bladder actuators 108 are deflated and disengage the wheels 150 when the gas bladders 108 are inflated.

An appropriate fluid supply 158 and fluid line 138 are coupled to each of the air bladders 112, 114 to provide a compressible fluid, such as air or nitrogen to expand the air bladders 112, 114. It should also be understood that each of the air bladders can be expanded with a gas such as nitrogen as determined by the user of the air actuated retarder. Appropriate controls to the fluid supply, valve trains, and gas bladders control the operation of the gas actuated retarder. Controls can be hard-wired or wireless with appropriate connections, for example with a controller 160, such as a computer.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of the present air actuated retarder has been shown and described with reference to particular embodiments and applications thereof, it has been presented for purposes of illustration and description and is not intended to be exhaustive or to limit the disclosure to the particular embodiments and applications disclosed. It will be apparent to those having ordinary skill in the art that a number of changes, modifications, variations, or alterations to the disclosure as described herein may be made, none of which depart from the spirit or scope of the present disclosure. The particular embodiments and applications were chosen and described to provide the best illustration of the principles of and practical application to thereby enable one of ordinary skill in the art to utilize the disclosure in various embodiments and with various modifications as are suited to the particular use contemplated. All such changes, modifications, variations, and alterations should therefore be seen as being within the scope of the present disclosure.

What is claimed is:

1. A gas actuated retarder system to resist movement of a railway car moving on wheels along a track section having a first and second running rail, the gas actuated retarder system comprising:

a plurality of steel ties positioned substantially parallel to each other and perpendicular to the first and second running rails of the track section;

a plurality of gas bladder actuators disposed between the running rails, with each gas bladder actuator comprising;

a gas bladder mount;

a first gas bladder and a second gas bladder, each coupled to the gas bladder mount with one gas bladder on each side of the bladder mount;

a pair of lever arms with each lever arm having a first end and a second end, with the first end of each lever arm coupled to one of the gas bladders and the second end of each lever pivotally coupled to a pivot pin secured to one of the steel ties;

a fulcrum bar with one end coupled to each of the second ends of two levers and to each pivot pin;

a brake clevis including a link arm coupled between the first and second ends of each lever arm proximate the pivot pin, with the clevis extending toward the running rail on each side of the track section;

a gas supple line coupled to each of the gas bladder of each of the gas bladder actuators configured to expand each gas bladder;

a pair of brake beams with one beam coupled to each clevis on one side of each of the plurality of gas bladder actuators with each brake beam parallel to one of the running rails; and a brake shoe coupled to each brake beam and configured to engage the wheels of the railway car when the gas bladder actuators are inflated and disengage the wheels when the gas bladders are deflated.

2. The gas actuated retarder system of claim 1, further comprising a controller coupled to the gas supply line and configured to selectively control the expansion and deflation of gas bladders in each of the gas bladder actuators.

3. The gas actuated retarder system of claim 1 further comprising a second lever arm coupled to each of the lever arms of each of the gas bladder actuators, with the second lever arm disposed a spaced distance below the other lever arm with the second lever arm coupled to the corresponding gas bladder and pivot pin of the other lever arm.

4. The gas actuated retarder system of claim 1 further comprising an ultra-high molecular weight plastic member disposed in a sliding area under each lever arm and brake beam.

5. The gas actuated retarder system of claim 1, wherein each brake beam substantially extends the full length of the gas actuated retarder system.

6. The gas actuated retarder system of claim 1, wherein the gas bladder mount of each gas bladder actuator is substantially equidistant from each running rail of the track section.

7. The gas actuated retarder system of claim 1, wherein the gas is one of air and nitrogen.

8. The gas actuated retarder system of claim 1, further comprising a walkway structure above the plurality of gas bladder actuators.

9. A gas actuated retarder system to resist movement of a railway car moving on wheels along a track section having a first and second running rail, the gas actuated retarder system comprising:

a plurality of steel ties positioned substantially parallel to each other and perpendicular to the first and second running rails of the track section;

a plurality of gas bladder actuators disposed between the running rails, with each gas bladder actuator comprising;

a gas bladder mount;

a first gas bladder and a second gas bladder, each coupled to the gas bladder mount with one gas bladder on an opposite side of the bladder mount;

a pair of lever arms with each lever arm having a first end and a second end, with the first end of each lever arm coupled to one of the gas bladders and the second end of each lever pivotally coupled to a pivot pin secured to one of the steel ties;

a fulcrum bar with one end coupled to each of the second ends of two levers and to each pivot pin;

a first clevis including a link arm coupled between the first and second ends of each lever arm proximate the pivot pin, with the clevis extending toward the running rail on each side of the track section;

a second clevis coupled between the first end and the first clevis to each lever arm and a compression spring coupled to each of the second clevises with the compression spring configured to exert a force against each lever arm causing the lever arms to pivot about the respective pivot pin and move the first clevis away from each of the running rails of the track section.

a gas supply line coupled to each of the gas bladder of each of the gas bladder actuators configured to expand each gas bladder;

a pair of brake beams with one beam coupled to each clevis on one side of each of the plurality of gas bladder actuators with each brake beam parallel to one of the running rails; and a brake shoe coupled to each brake beam and configured to engage the wheels of the railway car when the gas bladder actuators are deflated and disengage the wheels when the gas bladders are inflated.

10. The gas actuated retarder system of claim 9, further comprising a controller coupled to the gas supply line and configured to selectively control the expansion and deflation of gas bladders in each of the gas bladder actuators.

11. The gas actuated retarder system of claim 9 further comprising a second lever arm coupled to each of the lever arms of each of the gas bladder actuators, with the second lever arm disposed a spaced distance below the other lever arm with the second lever arm coupled to the corresponding gas bladder and pivot pin of the other lever arm.

12. The gas actuated retarder system of claim 9 further comprising an ultra-high molecular weight plastic member disposed in a sliding area under each lever arm and brake beam.

13. The gas actuated retarder system of claim 9, wherein each brake beam substantially extends the full length of the gas actuated retarder system.

14. The gas actuated retarder system of claim 9, wherein the gas bladder mount of each gas bladder actuator is disposed proximate each of the running rails of the track section.

15. The gas actuated retarder system of claim 9, wherein the gas is one of air and nitrogen.

16. The gas actuated retarder system of claim 9, further comprising a walkway structure above the plurality of gas bladder actuators.

* * * * *